US010414154B2

(12) United States Patent
Alfekri et al.

(10) Patent No.: US 10,414,154 B2
(45) Date of Patent: Sep. 17, 2019

(54) TRANSFERRING IMAGES

(71) Applicant: HEWLETT-PACKARD DEVELOPMENT COMPANY, L.P., Houston, TX (US)

(72) Inventors: Dheya Alfekri, San Diego, CA (US); Douglas Knight, Santa Barbara, CA (US); Ronald J. Selensky, Poway, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/069,505

(22) PCT Filed: Mar. 18, 2016

(86) PCT No.: PCT/US2016/023190
§ 371 (c)(1),
(2) Date: Jul. 11, 2018

(87) PCT Pub. No.: WO2017/160313
PCT Pub. Date: Sep. 21, 2017

(65) Prior Publication Data

US 2019/0009520 A1 Jan. 10, 2019

(51) Int. Cl.
*B41J 2/005* (2006.01)
*B41M 5/03* (2006.01)
(Continued)

(52) U.S. Cl.
CPC ..... *B41J 2/0057* (2013.01); *B41M 5/0256* (2013.01); *B41M 5/03* (2013.01);
(Continued)

(58) Field of Classification Search
CPC ... B41J 2/0057; B44C 1/1712; B41M 5/0057; B41M 5/0256; B41M 5/03;
(Continued)

(56) References Cited

U.S. PATENT DOCUMENTS 4,037,008 A 7/1977 Tugwell
5,328,749 A 7/1994 Noda et al.
(Continued)

FOREIGN PATENT DOCUMENTS

EP 0463517 1/1992
EP 0926547 6/1999
(Continued)

OTHER PUBLICATIONS

International Search Report and Written Opinion for International Publication No. PCT/US2016/023190 dated Dec. 8, 2016, 10 pages.
(Continued)

*Primary Examiner* — Anh T Vo
(74) *Attorney, Agent, or Firm* — Dierker & Kavanaugh PC

(57) ABSTRACT

In an example implementation, an image transfer method includes inkjet printing a latex ink image onto a propylene-ethylene copolymer film extruded onto a single-layer image transfer sheet. The method includes putting the latex ink image and the single-layer image transfer sheet in contact with a substrate, and using heat and pressure to exclusively transfer the latex ink image onto the substrate, after which the single-layer transfer sheet is removed from the substrate.

15 Claims, 6 Drawing Sheets

(51) Int. Cl.

| | |
|---|---|
| ***B41M 5/035*** | (2006.01) |
| ***B41M 5/025*** | (2006.01) |
| ***B44C 1/17*** | (2006.01) |
| ***B41M 5/52*** | (2006.01) |
| *B41M 7/00* | (2006.01) |

(52) U.S. Cl.
CPC ..... *B41M 5/0358* (2013.01); *B41M 5/5254* (2013.01); *B44C 1/1712* (2013.01); *B41M 7/0027* (2013.01); *B41M 2205/10* (2013.01); *B41M 2205/38* (2013.01)

(58) Field of Classification Search
CPC ..... B41M 5/0358; B41M 5/5254; B41M 7/0027; B41M 2205/10; B41M 2205/38; B41M 2205/42
See application file for complete search history.

(56) References Cited

U.S. PATENT DOCUMENTS

| | | | | |
|---|---|---|---|---|
| 5,334,439 | A | 8/1994 | Kawaguchi et al. | |
| 5,789,134 | A | 8/1998 | Brault et al. | |
| 5,981,077 | A | 11/1999 | Taniguchi | |
| 7,081,324 | B1 * | 7/2006 | Hare | B44C 1/1712 156/240 |
| 2003/0008116 | A1 | 1/2003 | Williams et al. | |
| 2008/0043087 | A1 | 2/2008 | Cowan | |
| 2010/0055371 | A1 | 3/2010 | Edwards et al. | |
| 2011/0139358 | A1 * | 6/2011 | Dolsey | B41M 5/0256 156/230 |
| 2012/0088097 | A1 | 4/2012 | Giammarco et al. | |
| 2012/0325401 | A1 * | 12/2012 | Dolsey | B41M 5/0256 156/247 |
| 2014/0017473 | A1 | 1/2014 | Bi et al. | |
| 2014/0204145 | A1 | 7/2014 | Ohnishi | |

FOREIGN PATENT DOCUMENTS

| | | |
|---|---|---|
| EP | 2535200 | 12/2012 |
| JP | S5511807 | 1/1980 |
| WO | WO03020528 | 3/2003 |
| WO | WO03039880 | 5/2003 |

OTHER PUBLICATIONS

"What Is HP Latex Ink?", May 1, 2014, XP955522288, 4 pages http://www.wide-format-printers.org.

* cited by examiner

TRANSFERRING IMAGES

BACKGROUND

The application or transfer of images onto apparel and other articles is increasingly popular and continues to drive growth within the custom printing industry. Substrates used for custom printing can include, for example, labels, signs, stationary, upholstery, towels, walls, cups, glasses, plates and apparel such as T-shirts, caps, jackets and shoes, made from a variety of different materials including natural cotton and silk fabrics, synthetic polyester fabrics, and so on. Different methods of applying or transferring images can be used to produce accurate and durable printed articles. The methods can vary based on the types of substrate materials to be receiving the images, the types of inks used to form the images, and other factors.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
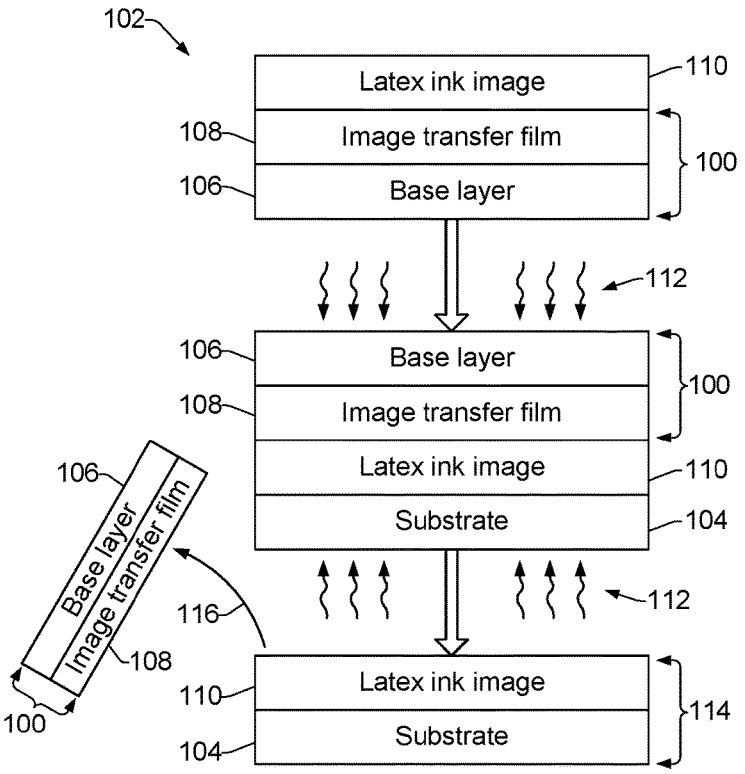
FIG. 1 shows a block diagram illustrating an example of an image transfer article that can be implemented in an example image transfer process to transfer an inkjet-printed image onto a substrate.

Different types of inks can be used to apply images onto specific substrates to produce accurate and durable printed articles. However, there is a significant impact in cost to print shops for producing printed articles of particular and varying substrate types. Each different family of media, or substrate, can use a different type of specialty printer and ink to achieve end user demands for high quality image accuracy and durability of printed articles. For example, particular inks such as UV (pigment) inks exhibit special properties on certain media, but not on other media. This is also true with other inks such as solvent inks and sublimation dye inks.

Sublimation printing with sublimation dye inks is often used for transferring images to a substrate such as a t-shirt. In sublimation printing, an image is printed onto a special sheet of paper and then transferred onto the substrate fabric using high heat and pressure to infuse the ink into the fabric.

While the image on the printed article (e.g., t-shirt) is durable, sublimation printing is limited to use with substrates that are a polyester synthetic material. Sublimation dye inks bond well with the fibers in polyester material when heat and pressure are applied. However, they do not bond well with natural fibers such as cotton, wool, canvas, and so on. Images transferred by sublimation to such natural fiber substrates are not durable and wash out easily from these substrates.

In general, while there are reasonably successful methods for applying or transferring images to some specific material substrates, there are practical limitations when applying or transferring images to other complex or hard to handle substrates (e.g., genuine leather, faux leather, heavy and light fabric). There are also similar practical limitations for print shops wanting to transfer images to a variety of different types of substrates. Applying printed images to complex substrates and/or varying types of substrates can involve the use of a number of different types of printing systems. Multiple types of printing systems increases printing costs significantly for printing shops. Alternatively, or in addition, applying printed images to complex substrates and/or varying types of substrates can involve making special modifications to existing printing systems, such as modifications to the drive system that moves the media substrate through the printing system. The increased costs of operating multiple types of printing systems and/or making such system modifications can be prohibitive for many print shops.

Accordingly, disclosed herein are example methods using an example image transfer article that enable the transfer of printed latex ink images onto many different types of substrate materials. An image transfer film formed by extruding a propylene-ethylene copolymer material onto a base layer, such as paper and silicone coated substrates, accepts and absorbs non-aqueous ink such as latex ink from an inkjet printer to provide a high quality printed image. The image can then be cleanly released from the film onto virtually any type of substrate under heat and pressure. Thus, while some surfaces can be unreceptive to ink from inkjet printers and result in poor image quality, the extruded film is receptive to latex inks and other high viscosity inks from inkjet printers to enable high quality printed images.

In some examples, a latex ink image can be inkjet printed in reverse onto the image transfer film, and the image and film can be brought into contact with a substrate. In an "ink-only" transfer process referred to as an imbibing process, the printed ink image can be transferred to the substrate by application of heat and pressure, and the base layer and film can be removed from the substrate. In other examples, the base layer can include a release layer such as a silicon release layer on which the image transfer film is formed by extrusion. In a process referred to as a "transfer process", the film, along with a latex ink image printed in reverse onto the film, can both be transferred to the substrate by application of heat and pressure. In some examples, and depending in part on the thickness of the film, the transferred film can remain on the substrate or it can be removed or peeled away from the substrate.

In one example implementation, an image transfer method includes inkjet printing a latex ink image onto a propylene-ethylene copolymer film that has been extruded onto a single-layer image transfer sheet. The method also includes putting the latex ink image and the single-layer image transfer sheet in contact with a substrate and using heat and pressure to transfer exclusively, the latex ink image onto the substrate. The method further includes removing the single-layer transfer sheet from the substrate after the transferring.

In another example implementation, an image transfer method includes inkjet printing a latex ink image onto an image transfer film of an image transfer sheet. The image transfer sheet includes a base paper and the image transfer film which is formed on the base paper by an extrusion of propylene-ethylene copolymer material. The method includes contacting the latex ink image and the image transfer film with a substrate and applying heat and pressure to the image transfer sheet and the substrate to transfer the latex ink image from the image transfer film to the substrate as a dry latex ink image. The image transfer sheet is then removed from the substrate.

In another example implementation, an image transfer article includes a single-layer image transfer sheet. The image transfer article also includes an image transfer film formed by extrusion of a propylene-ethylene copolymer material onto the single-layer image transfer sheet. The film is to receive an inkjet-printed latex image, and to transfer the latex image to a substrate when in contact with the substrate under heat and pressure.

Figure 2:
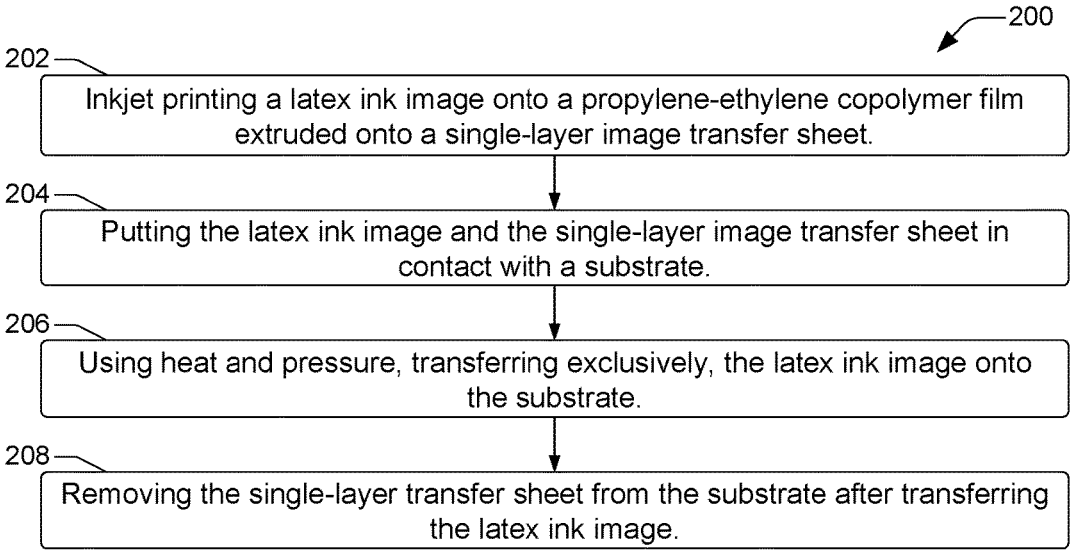
FIG. 2 shows a flow diagram of an example method that can be used to implement the example process of FIG. 1.

FIG. 1 shows a block diagram illustrating an example of an image transfer article 100 that can be implemented in an example image transfer process 102 to transfer an inkjet-printed image onto a substrate 104, such as a fabric or other type of substrate material. FIG. 2 shows a flow diagram of a method 200 that can be used to implement the example process 102 illustrated in FIG. 1. As shown in FIG. 1, an example image transfer article 100 (alternately referred to as an image transfer sheet 100) can include a single layer, illustrated as a single base layer 106, onto which an image transfer film can be formed. An image transfer film is illustrated as image transfer film 108 that can be formed, for example, by an extrusion process. The image transfer film 108 may be variously referred to herein as image transfer film, film, surface film, extruded film, propylene-ethylene copolymer film, and the like. The base layer 106 can be implemented as a paper base layer, or as another suitable type of base material layer. The film 108 comprises an extrusion of a propylene-ethylene copolymer material comprising plastomers and elastomers. The extruded film 108 and propylene-ethylene copolymer material are discussed in more detail herein below.

In different examples, an extruded film 108 can have different thicknesses generated during the formation of the film 108 onto the base layer 106. In the present example shown in FIG. 1, the film 108 is formed directly onto the single base layer 106. Thus, in the example shown in FIG. 1, there is no intervening release layer between the base layer 106 and the film 108 as in other examples discussed below. In this example, the film 108 can have a thickness on the order of 5.0 mil (0.005") or greater, which can be thicker than in other examples where there is an intervening release layer between the base layer 106 and the film 108. When the film 108 is formed directly onto the single base layer 106 in this manner, it becomes firmly adhered to the base layer 106.

The image transfer film 108 can be formed on the base layer 106 using an extrusion process. Thus, the film 108 comprises an extruded film 108. While an extrusion process is not illustrated, in one suitable example of an extrusion process the propylene-ethylene copolymer material (e.g., resin pellets) can be heated to form a resin that is pushed through an extrusion die and cast into a thin film on or over the base layer 106. The thin film is immediately adhered to or nipped onto the base layer 106, forming the image transfer sheet 100. In some examples, the image transfer sheet 100 can be a continuous sheet and can be wound into rolls for large and small format printing purposes. For example, the image transfer sheet 100 (e.g., the extruded film 108 on the base layer 106) can be printed with latex ink or other types of inks using an inkjet printer.

As shown in FIG. 1, a latex ink image 110 can be printed onto the image transfer film 108. The latex image can be printed in reverse orientation and subsequently transferred onto other substrates using heat and pressure. While a latex ink image 110 is illustrated, other inks may be appropriate to form an image 110 on the film 108. Other appropriate inks can include high viscosity, non-aqueous inks that are jettable from thermal and/or piezoelectric inkjet printers. Thus, the latex ink image 110 comprises an inkjet-printed image. As used herein, aqueous inks generally include inks in which the colorant (i.e., dye or pigment) is either dissolved in water or suspended in water, while non-aqueous inks include inks in which the carrier for the colorant (i.e., pigment) is a latex or resin-based carrier.

Referring still to FIGS. 1 and 2, an image transfer method 200 includes inkjet printing a latex ink image 110 onto a propylene-ethylene copolymer film 108 that is extruded onto a single-layer image transfer sheet 100 (block 202, FIG. 2). The latex ink image 110 can be printed in reverse orientation onto the film 108. The image transfer sheet 100 with the reverse-printed latex ink image 110 can then be flipped over and the film 108 and ink image 110 can be brought into contact with a substrate 104 (block 204, FIG. 2). Substrate 104 can be formed of a wide variety of materials including, for example, metals and wood for signage, PET film, PET fabric, natural fabrics, cotton, silk, flooring and wall materials, glass, upholstery, materials for shoes, and many others.

Heat and pressure 112 can then be applied to the substrate 104 and the image transfer sheet 100 as shown in FIG. 1 (e.g., 350-375° F. applied with medium pressure for approximately 30 seconds), which results in exclusively transferring the latex ink image 110 onto the substrate 104 (block 206, FIG. 2). Application of heat and pressure cleanly releases the latex ink image 110 from the image transfer film 108 and transfers the image 110 onto the substrate 104. Thus, exclusively transferring the latex ink image 110 is intended to indicate that no other portion of the image transfer sheet 100 transfers to the substrate 104 along with the image 110. This transfer process comprises an imbibing process and can be referred to as an "ink-only" or "image-only" transfer that transfers just the ink image from the image transfer sheet 100 to the substrate 104. In this process, the latex ink image 110 transfers as a dry latex ink image that has been cured in the printer after being printed onto the image transfer film 108. Thus, before, during, and after the transfer to a substrate 104, the latex ink image is dry and has infinite viscosity.

After transferring the latex ink image 110 to the substrate 104, the image transfer sheet 100 can be removed 116 from the substrate 104, for example, by peeling away 116 the image transfer sheet 100 from the substrate 104 as shown in FIG. 1 (block 208, FIG. 2). Furthermore, the firm adherence of the image transfer film 108 to the base layer 106 which results from the extrusion process noted above, causes the film 108 to be fully removed from the substrate 104 when the image transfer sheet 100 is removed from the substrate 104. Thus, a resultant imaged substrate 114 includes just the latex ink image 110 cleanly transferred to the substrate 104.

Figure 3:
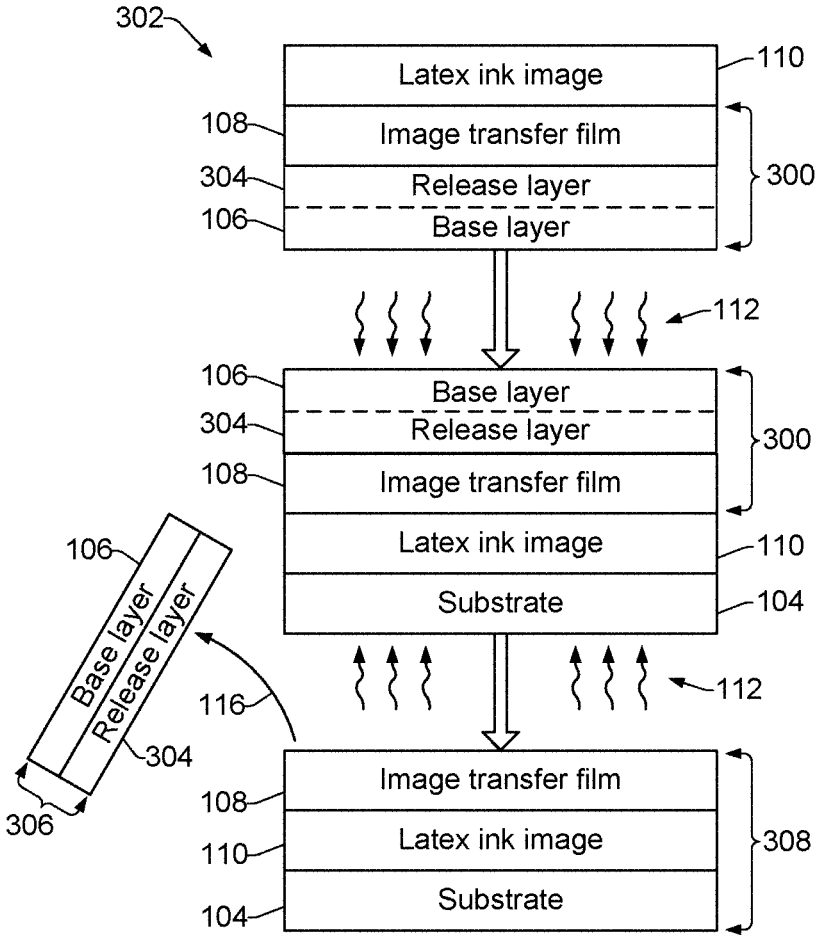
FIG. 3 shows a block diagram illustrating an example of an image transfer article that can be implemented in an example image transfer process to transfer an inkjet-printed image onto a substrate.

FIG. 3 shows a block diagram illustrating another example of an image transfer article 300 (i.e., image transfer sheet 300) that can be implemented in an example image transfer process 302 to transfer an inkjet-printed image onto a substrate 104, such as a fabric or other type of substrate material. The example image transfer sheet 300 includes a base layer 106, such as a paper base layer. The example image transfer sheet 300 additionally includes a release layer 304 formed on the base layer 106. The release layer 304 comprises a coating on the base layer 106 such as a silicone coating.

The image transfer film 108 can be formed on the release layer 304 base layer 106 using an extrusion process as discussed above. During the extrusion process, the film 108 is adhered to or nipped onto the release layer 304. In this example, the propylene-ethylene copolymer material pellets are extruded into a thin film 108 which has a thickness in the range of approximately 0.3 to 0.7 mil (0.0003 to 0.0007"), enabling the film 108 to be cleanly and fully transferred to the substrate 104. Together, the base layer 106, the release layer 304, and the film 108 form the image transfer sheet 300. As noted above, an image transfer sheet 300 can be a continuous sheet and can be wound into rolls for large and small format printing purposes. Thus, the image transfer sheet 300 can be printed with latex ink or other types of inks using an inkjet printer.

As shown in FIG. 3, after a latex ink image 110 is printed in reverse orientation onto the image transfer film 108, it can be transferred onto a substrate 104 using heat and pressure 112 in a manner similar to that discussed above regarding the process 102 of FIG. 1. Thus, heat and pressure 112 can then be applied to the substrate 104 and the image transfer sheet 300 as shown in FIG. 3. In this example, however, because of the presence of the release layer 304, application of heat and pressure releases both the film 108 and the latex ink image 110 from the image transfer sheet 300 and transfers them both onto the substrate 104. After transferring both the film 108 and the latex ink image 110 from the image transfer sheet 300 to the substrate 104, an image transfer sheet portion 306 can be removed 116 from the substrate 104, for example, by peeling 116 away the image transfer sheet portion 306 from the substrate 104 as shown in FIG. 3. The image transfer sheet portion 306 includes the base layer 106 and the release layer 304, but not the image transfer film 108.

In this example, as shown in FIG. 3, peeling 116 away the image transfer sheet portion 306 from the substrate 104 leaves behind both the image transfer film 108 and the latex image 110 on the substrate 104. The release layer 304 enables a clean transfer of the entire film 108 onto the substrate 104. Thus, a resultant imaged substrate 308 includes both the film 108 and the latex ink image 110 cleanly transferred onto the substrate 104.

Figure 4:
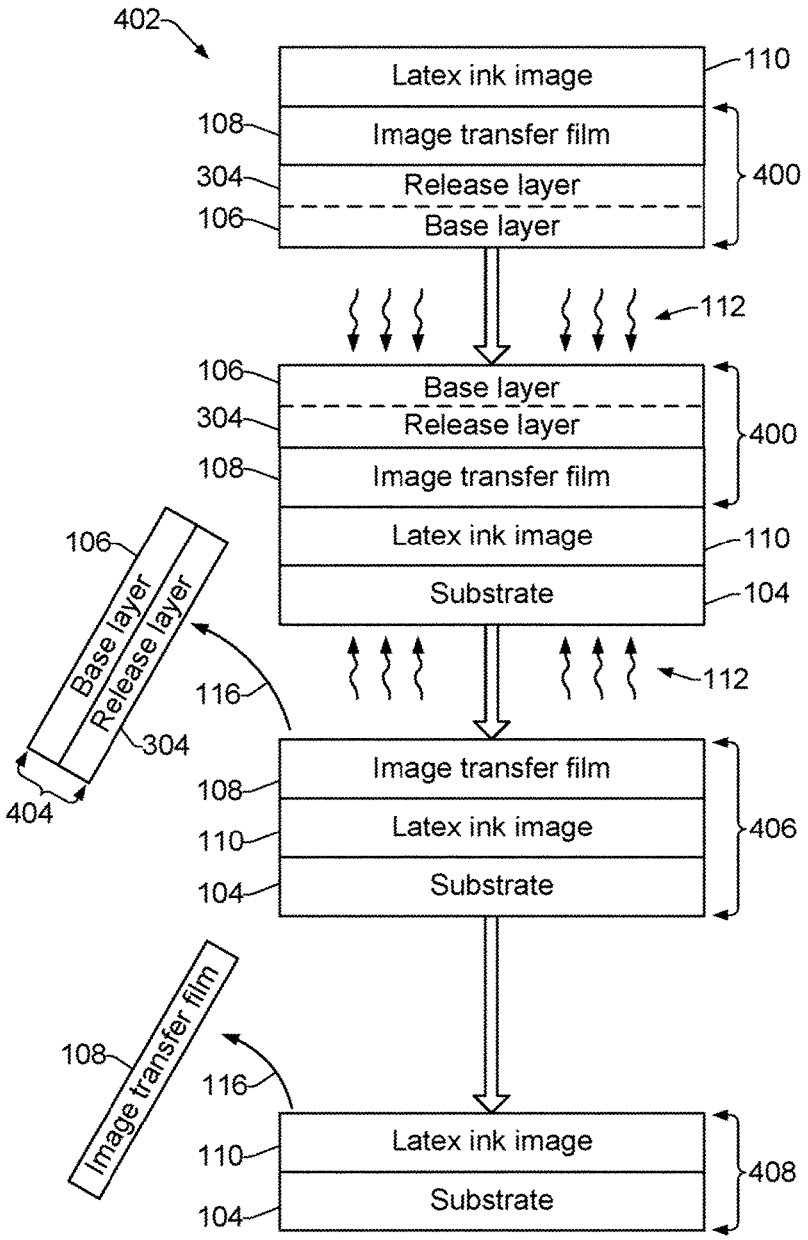
FIG. 4 shows a block diagram illustrating another example of an image transfer article that can be implemented in an example image transfer process to transfer an inkjet-printed image onto a substrate.

FIG. 4 shows a block diagram illustrating another example of an image transfer article 400 (i.e., image transfer sheet 400) that can be implemented in an example image transfer process 402 to transfer an inkjet-printed image onto a substrate 104, such as a fabric or other type of substrate material. The example image transfer sheet 400 includes a base layer 106 and a release layer 304 as discussed above with regard to FIG. 3.

The image transfer film 108 can be formed on the release layer 304 base layer 106 using an extrusion process as discussed above. In this example, the propylene-ethylene copolymer material pellets are extruded into a thin film 108 which has a thickness in the range of approximately 1.5 to 5.0 mil (0.0015 to 0.005"). The thickness of the film 108 in this example enables the film 108 to be cleanly and fully transferred to the substrate 104, and then to be subsequently removed or peeled away as discussed below. Together, the base layer 106, the release layer 304, and the film 108 form the image transfer sheet 400. As noted above, an image transfer sheet 400 can be a continuous sheet and can be wound into rolls for large and small format printing purposes. Thus, the image transfer sheet 400 can be printed with latex ink or other types of inks using an inkjet printer.

After a latex ink image 110 is printed in reverse orientation onto the image transfer film 108, it can be transferred onto a substrate 104 using heat and pressure 112 in a manner similar to that discussed above regarding the process 102 of FIG. 1. With the application of heat and pressure 112, the release layer 304 facilitates a clean release of the film 108 and the latex ink image 110 from the image transfer sheet 400 onto the substrate 104. After transferring both the film 108 and the latex ink image 110 from the image transfer sheet 400 to the substrate 104, an image transfer sheet portion 404 can be removed 116 from the substrate 104, for example, by peeling 116 away the image transfer sheet portion 404 from the substrate 104 as shown in FIG. 4. The image transfer sheet portion 404 includes the base layer 106 and the release layer 304, but not the image transfer film 108.

In this example, as shown in FIG. 4, peeling 116 away the image transfer sheet portion 404 from the substrate 104 leaves behind both the image transfer film 108 and the latex image 110 on the substrate 104. The release layer 304 enables a clean transfer of the entire film 108 onto the substrate 104. In this example, as noted above the film 108 has a thickness in the range of approximately 1.5 to 5.0 millimeters. The increased thickness of the film 108 compared to that in the FIG. 3 example, enables the film 108 to be cleanly removed 116 or peeled away from the substrate 104 such that no portion of the film 108 remains on the substrate 104. Thus, a resultant imaged substrate 408 includes just the latex ink image 110 cleanly transferred onto the substrate 104.

Figure 5:
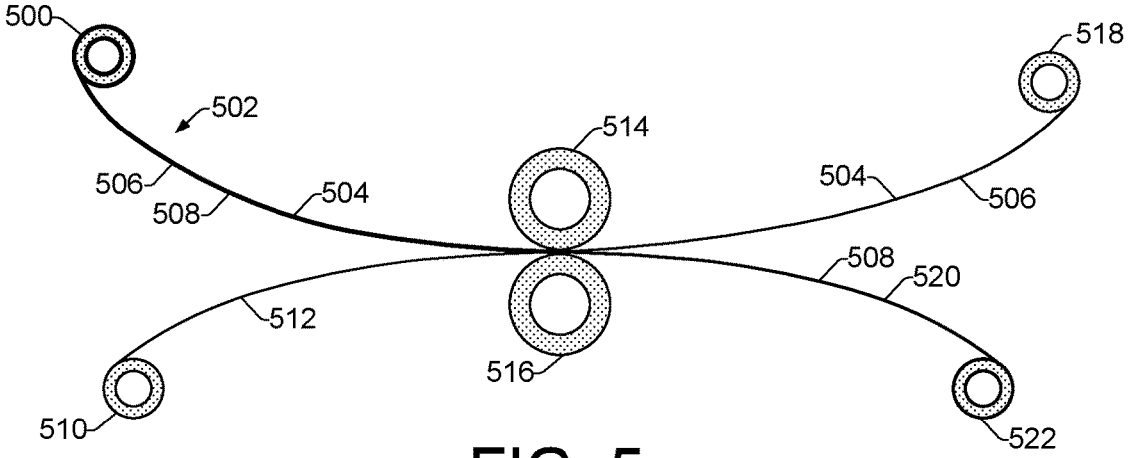
FIG. 5 shows a diagram illustrating an example process for transferring ink-jet printed images from a roll of image transfer sheets onto a substrate without transferring an image transfer film.
Figure 6:
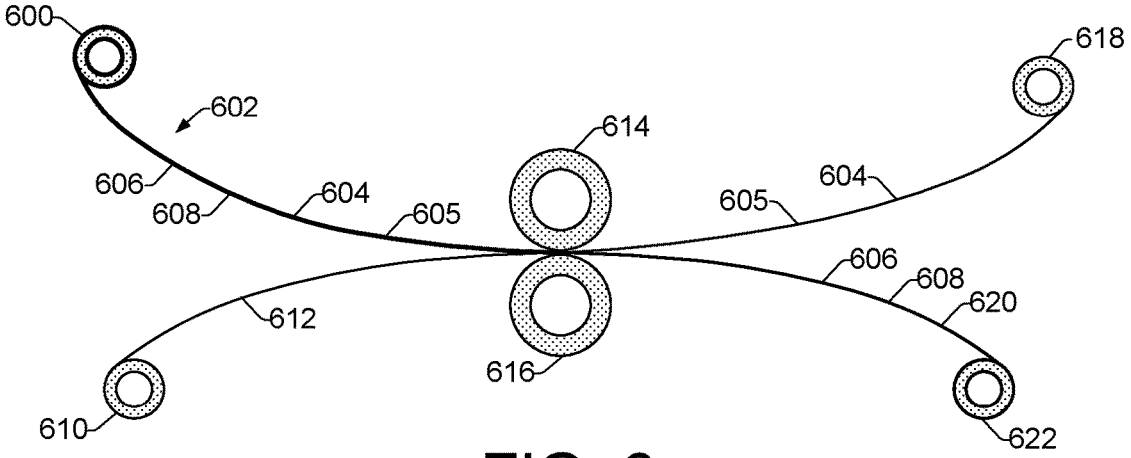
FIG. 6 shows a diagram illustrating an example process for transferring ink-jet printed images and an image transfer film from a roll of image transfer sheets onto a substrate.

As noted above regarding FIGS. 1-4, an image transfer sheet 100, 300, 400 can be a continuous sheet that can be wound into rolls for large and small format printing purposes. FIGS. 5 and 6 show diagrams illustrating processes for transferring ink-jet printed images from a roll of image transfer sheets onto a substrate. In FIG. 5, the process does not transfer an image transfer film to the substrate. In FIG. 6, the process does transfer an image transfer film to the substrate. Referring to FIG. 5, an image transfer sheet roll 500 includes a continuous roll of image transfer sheets 502 comprising a base layer 504 on one side of each sheet 502. On the opposite side of the image transfer sheets 502 are, an image transfer film 506 extruded onto and firmly adhered to the base layer 504, and latex ink images 508 preprinted onto the image transfer film 506. The image transfer sheets 502 are therefore like the image transfer sheet 100 of FIG. 1, in that they comprise a single base layer and an extruded film without an intervening release layer in between the base layer and the film.

Also shown in FIG. 5, is a substrate roll 510. As noted above, a substrate can include a wide variety of substrate material, including various fabrics suitable for storage and dispensing from a substrate roll 510. As the image transfer sheets 502 and substrate 512 are dispensed from their respective rolls 500, 510, they pass between a top hot roller 514 and bottom hot roller 516 that apply heat and pressure. Application of heat and pressure by the top hot roller 514 and bottom hot roller 516 cleanly releases the latex ink images 508 from the image transfer film 506 and transfers the image 508 onto the substrate 512 as the images and substrate 512 pass between the hot rollers 514, 516. Because the image transfer film 506 is firmly adhered by extrusion to the base layer 504, the film 506 is peeled away from or removed from the substrate along with the base layer 504 as each image transfer sheet portion and substrate portion exit from between the hot rollers 514, 516. The image transfer sheets are rolled back up on a blank roll 518 while the resultant imaged substrate portions 520 are rolled back up on an imaged substrate roll 522. Each imaged substrate portion 520 includes just the latex ink image 110 that is cleanly or exclusively transferred onto the substrate without transfer of the image transfer film 506.

Referring now to FIG. 6, a similar process is shown for transferring ink-jet printed images from a roll of image transfer sheets onto a substrate, while also transferring an image transfer film to the substrate. In FIG. 6, an image transfer sheet roll 600 includes a continuous roll of image transfer sheets 602 comprising a base layer 604 on one side of each sheet 602. In this example, a release layer 605 is formed on the base layer 604, as discussed above with regard to the examples of FIGS. 3 and 4. Thus, the release layer 605 comprises a coating on the base layer 604 such as a silicone coating. On the opposite side of the image transfer sheets 602 are, an image transfer film 606 extruded onto the release layer 605, and latex ink images 608 preprinted onto the image transfer film 606. The image transfer sheets 602 are therefore like the image transfer sheet 300 of FIG. 3, in that they comprise a base layer 604 with a release layer 605 coating, and an image transfer film 606 extruded onto the release layer 605.

Also shown in FIG. 6 is a substrate roll 610 that can include a variety of different substrate materials. As the image transfer sheets 602 and substrate 612 are dispensed from their respective rolls 600, 610, they pass between a top hot roller 614 and bottom hot roller 616 that apply heat and pressure. Application of heat and pressure by the top hot roller 614 and bottom hot roller 616 cleanly releases the latex ink images 608 and the image transfer film 606 from the release layer 605 of the image transfer sheets 602, transferring both the images 608 and the film 606 onto the substrate 612 as the images and substrate 612 pass between the hot rollers 614, 616. Because the image transfer film 606 is extruded onto the release layer 605, the film 606 transfers to the substrate and is not removed or peeled away from the substrate as each image transfer sheet portion and substrate portion exit from between the hot rollers 614, 616. The release layer 605 enables a clean transfer of the entire image transfer film 606 onto the substrate 104. The image transfer sheets are rolled back up on a blank roll 618 while the resultant imaged substrate portions 620 portions are rolled back up on an imaged substrate roll 622. Each imaged substrate portion 620 includes image transfer film 606 and the latex ink image 110 both transferred onto the substrate.

Figure 7:
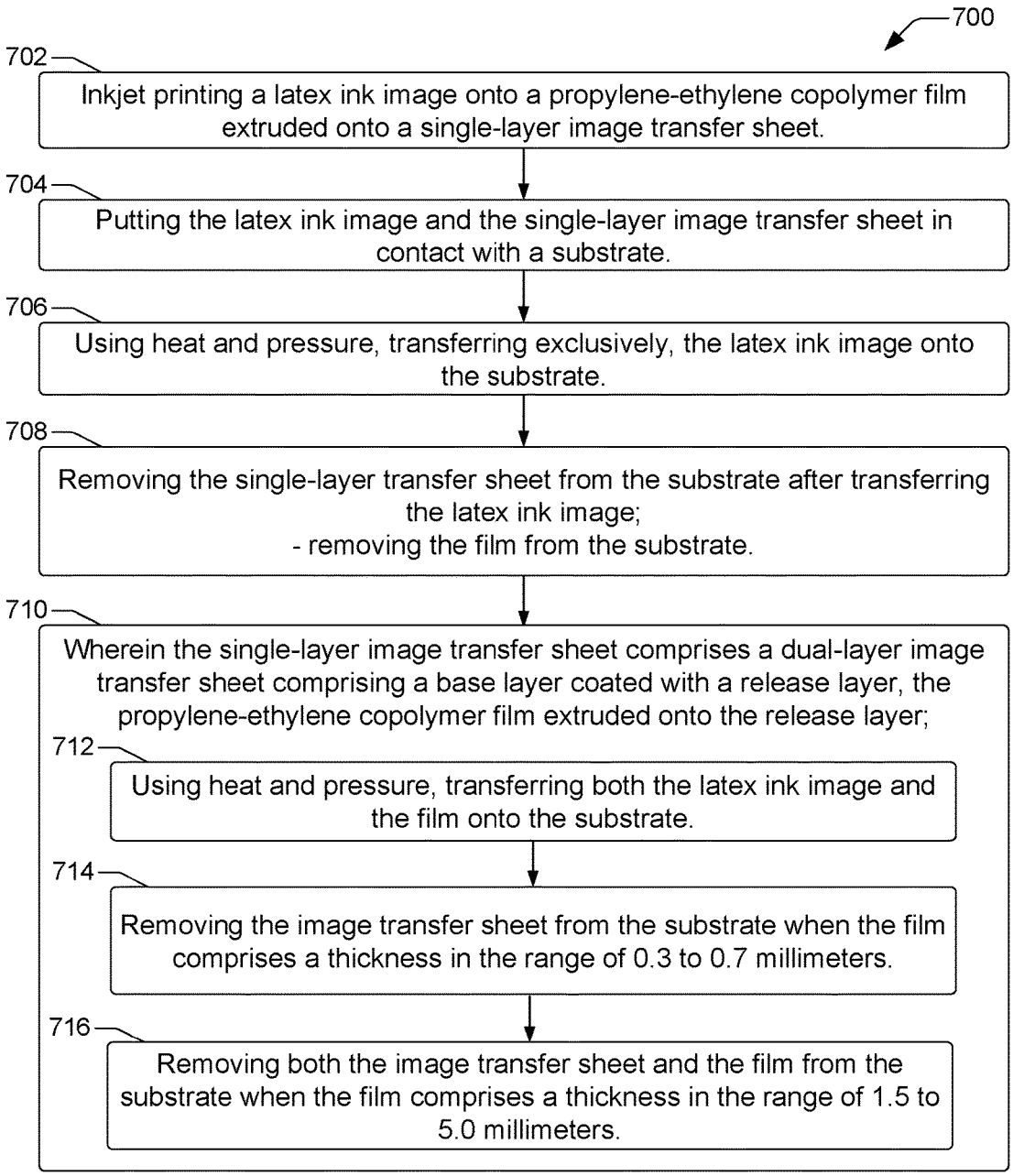
FIGS. 7 and 8 are flow diagrams showing example image transfer methods.
Figure 8:
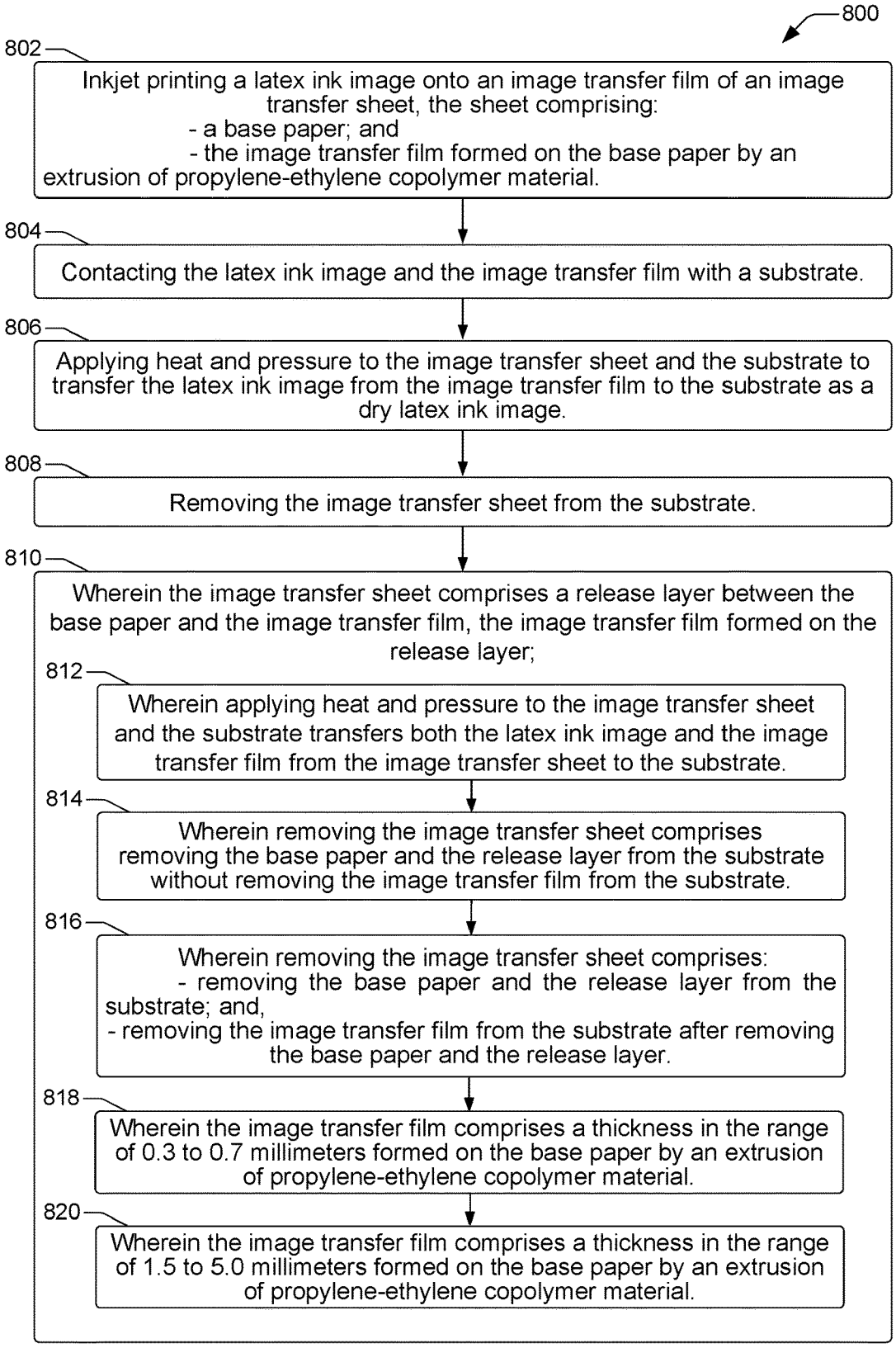

FIGS. 7 and 8 are flow diagrams showing example image transfer methods 700 and 800, respectively. Method 700 is an extension of method 200 above with additional details. Thus, method 700 includes inkjet printing a latex ink image onto a propylene-ethylene copolymer image transfer film that is extruded onto a single-layer image transfer sheet, as shown at block 702. As shown at block 704, the method 700 includes putting the latex ink image and the single-layer image transfer sheet in contact with a substrate. The method continues at block 706 with using heat and pressure to transfer exclusively, the latex ink image onto the substrate. As shown at block 708, the method includes removing the single-layer transfer sheet from the substrate after transferring the latex ink image. In some examples, removing the transfer sheet includes removing the image transfer film extruded onto the single-layer image transfer sheet from the substrate.

As shown at block 710 of method 700, in some examples the single-layer image transfer sheet comprises a dual-layer image transfer sheet having a base layer coated with a release layer, where the propylene-ethylene copolymer image transfer film is extruded onto the release layer. In these examples, heat and pressure can be used to transfer both the latex ink image and the film onto the substrate, as shown at block 712. As shown at block 714, the image transfer sheet can be removed from the substrate when the film comprises a thickness in the range of 0.3 to 0.7 mil (0.0003 to 0.0007"). As shown at block 716, both the image transfer sheet and the film can be removed from the substrate when the film comprises a thickness in the range of 1.5 to 5.0 millimeters.

Referring now to FIG. 8, the image transfer method 800 includes inkjet printing a latex ink image on an image transfer sheet, as shown at block 802. In this example, the image transfer sheet comprises a base paper and the image transfer film is formed on the base paper by an extrusion of propylene-ethylene copolymer material. As shown at blocks 804, 806, and 808, respectively, the method 800 includes contacting the latex ink image and the image transfer film with a substrate, applying heat and pressure to the image transfer sheet and the substrate to transfer the latex ink image from the surface film to the substrate as a dry latex ink image, and removing the image transfer sheet from the substrate.

Continuing at block 810, in some examples the image transfer sheet comprises a release layer between the base paper and the image transfer film, with the image transfer film being formed on the release layer. As shown at block 812, in such examples, applying heat and pressure to the image transfer sheet and the substrate transfers both the latex ink image and the film from the image transfer sheet to the substrate. As shown at block 814, removing the image transfer sheet comprises removing the base paper and the release layer from the substrate without removing the film from the substrate. In some examples, as shown at block 816, removing the image transfer sheet comprises removing the base paper and the release layer from the substrate, and then removing the image transfer film from the substrate after removing the base paper and the release layer. As shown at block 818, in some examples the image transfer film comprises a thickness in the range of 0.3 to 0.7 millimeters formed on the base paper by an extrusion of propylene-ethylene copolymer material. As shown at block 820, in some examples the image transfer film comprises a thickness in the range of 1.5 to 5.0 millimeters formed on the base paper by an extrusion of propylene-ethylene copolymer material.

As noted above in different examples, an image transfer film 108 comprises an extrusion of a propylene-ethylene copolymer material comprising plastomers and elastomers. In each of the examples, the extruded image transfer film 108 exhibits ink image transfer characteristics that provide improved accuracy, durability, and quality of printed ink images transferred from the film onto a wide variety of substrate materials. Image transfer characteristics of the extruded image transfer film 108 depend in part on physical properties at the film's surface and how these properties facilitate the printing of ink images onto the film, and the subsequent release and transfer of the printed ink images from the film to a substrate. For example, physical surface properties of the film can impact the film's receptivity to, and absorption of, different types of inks, as well as the film's ability to hold onto and release printed ink images under varying circumstances. Physical properties of a film's surface can include, for example, the film's smoothness, roughness, porosity or fluid absorption, surface tension, stiffness, contact angles, wettability, and so on.

One example of a propylene-ethylene copolymer material comprising plastomers and elastomers that is suitable to form (by extrusion) the image transfer films 108 discussed herein, is a commercially available product from the Dow Chemical Company offered under the name of VERSIFY™ Measured values of various surface properties for an extruded film 108 using the VERSIFY™ product are shown in Tables 1a and 1b, below. Each table "Item" represents a VERSIFY™ propylene-ethylene copolymer material and an image transfer film 108 that has been formed by an extrusion of that material.

TABLE 1a

| | Melting point | Film thickness | Stiffness | | Contact angle | |
|---|---|---|---|---|---|---|
| Item | ° C. | mil | Taber | Gurley | H2O | DIM |
| 1 | 89.58 | 0.5 | 4.20 | 361.52 | 95.40 | 52.215 |
| 2 | 89.70 | 1.0 | 5.50 | 453.49 | 92.32 | 86.345 |
| 3 | 86.43 | 0.5 | 4.93 | 412.97 | 92.36 | 67.65 |
| 4 | 86.42 | 5.0 | 5.19 | 431.99 | 97.90 | 57.675 |
| 5 | 86.32 | 5.0 | 6.65 | 534.88 | 78.68 | 55.74 |
| 6 | 86.98 | 1.0 | 5.81 | 475.33 | 97.69 | 60.675 |
| 7 | 88.46 | 3.0 | 5.02 | 420.01 | 93.33 | 58.685 |
| 8 | 86.77 | 1.5 | 4.90 | 411.56 | 95.32 | 60.355 |
| 9 | 87.66 | 1.0 | 5.64 | 463.00 | 97.37 | 57.585 |
| 10 | 60.45 | 1.5 | 4.11 | 355.18 | 100.87 | 64.94 |
| 11 | 87.83 | 0.5 | 4.65 | 393.59 | 91.54 | 59.07 |
| 12 | 63.00 | 1.0 | 7.54 | 597.25 | 42.60 | 52.95 |

TABLE 1b

| | Surface tension Total dispersive + | Smoothness Parker Print-Surf | Roughness Average | | Porosity or fluid absorption Parker Print-Surf |
|---|---|---|---|---|---|
| Item | polar | PPS | Ra, um | Rq, um | PPS |
| 1 | 33.76953 | 0.90 | 1.91 | 2.42 | 0.90 |
| 2 | 20.18962 | 0.96 | 8.475 | 9.805 | 0.96 |
| 3 | 26.98951 | 0.79 | 7.71 | 9.28 | 0.79 |
| 4 | 30.58738 | 1.69 | 2.16 | 2.55 | 1.69 |
| 5 | 37.05526 | 0.71 | 5.645 | 6.89 | 0.70 |
| 6 | 29.0781 | 1.03 | 3.89 | 4.58 | 1.02 |
| 7 | 30.92097 | 1.77 | 7.85 | 9.57 | 1.76 |
| 8 | 29.67483 | 0.97 | 3.205 | 3.835 | 0.97 |
| 9 | 30.71269 | 1.41 | 3.485 | 4.37 | 1.41 |
| 10 | 26.40856 | 0.62 | 9.605 | 11.295 | 0.62 |
| 11 | 31.16394 | 1.28 | 8.225 | 9.59 | 1.27 |
| 12 | 58.78212 | 0.67 | 0.93 | 1.14 | 0.67 |

What is claimed is:

1. An image transfer method comprising:

inkjet printing a latex ink image onto a propylene-ethylene copolymer film extruded onto a single-layer image transfer sheet;

putting the latex ink image and the single-layer image transfer sheet in contact with a substrate;

using heat and pressure, transferring exclusively, the latex ink image onto the substrate; and, removing the single-layer transfer sheet from the substrate after the transferring.

2. A method as in claim 1, wherein removing the single-layer transfer sheet from the substrate comprises removing the film from the substrate.

3. A method as in claim 1, wherein the single-layer image transfer sheet comprises a dual-layer image transfer sheet comprising a base layer coated with a release layer and the film extruded onto the release layer, the method further comprising:

using heat and pressure, transferring both the latex ink image and the film onto the substrate;

removing the image transfer sheet from the substrate when the film comprises a thickness in the range of 0.3 to 0.7 mil (0.0003 to 0.0007"); and, removing both the image transfer sheet and the film from the substrate when the film comprises a thickness in the range of 1.5 to 5.0 mil (0.0015 to 0.005").

4. An image transfer method comprising:

inkjet printing a latex ink image onto an image transfer film of an image transfer sheet, the image transfer sheet comprising:

a base paper; and the image transfer film formed on the base paper by an extrusion of propylene-ethylene copolymer material;

contacting the latex ink image and the image transfer film with a substrate;

applying heat and pressure to the image transfer sheet and the substrate to transfer the latex ink image from the image transfer film to the substrate as a dry latex ink image; and removing the image transfer sheet from the substrate.

5. A method as in claim 4, wherein:

the image transfer sheet comprises a release layer between the base paper and the image transfer film, the image transfer film formed on the release layer; and applying heat and pressure to the image transfer sheet and the substrate to transfer both the latex ink image and the image transfer film from the image transfer sheet to the substrate.

6. A method as in claim 5, wherein removing the image transfer sheet comprises:

removing the base paper and the release layer from the substrate without removing the image transfer film from the substrate.

7. A method as in claim 5, wherein removing the image transfer sheet comprises:

removing the base paper and the release layer from the substrate; and, removing the image transfer film from the substrate after removing the base paper and the release layer.

8. A method as in claim 6, wherein the image transfer film comprises a thickness in the range of 0.3 to 0.7 mil (0.0003 to 0.0007") formed on the base paper by an extrusion of propylene-ethylene copolymer material.

9. A method as in claim 7, wherein the image transfer film comprises a thickness in the range of 1.5 to 5.0 mil (0.0015 to 0.005") formed on the base paper by an extrusion of propylene-ethylene copolymer material.

10. An image transfer article comprising:

a single-layer image transfer sheet; and an image transfer film formed by extrusion of a propylene-ethylene copolymer material onto the single-layer image transfer sheet, the film to receive an inkjet-printed latex image, and to transfer the latex image to a substrate when in contact with the substrate under heat and pressure.

11. An image transfer article as in claim 10, wherein the single-layer image transfer sheet comprises a paper base layer.

12. An image transfer article as in claim 10, further comprising a release layer formed on the single-layer image transfer sheet in between the single-layer image transfer sheet and the film such that the film is formed by extrusion onto the release layer.

13. An image transfer article as in claim 10, wherein the film comprises a thickness in the range of 0.3 to 0.7 mil (0.0003 to 0.0007") and is to transfer to, and remain on, the substrate with the latex image when in contact with the substrate under heat and pressure.

14. An image transfer article as in claim 10, wherein the film comprises a thickness in the range of 1.5 to 5.0 mil (0.0015 to 0.005") and is to transfer to the substrate with the latex image when in contact with the substrate under heat and pressure and thereafter be removed from the substrate.

15. An image transfer article as in claim 10, wherein the propylene-ethylene copolymer material comprises plastomers and elastomers having a melting point within a temperature range of 86.32 and 89.70° C.

* * * * *